US008011060B2

(12) United States Patent
Liebig et al.

(10) Patent No.: US 8,011,060 B2
(45) Date of Patent: Sep. 6, 2011

(54) UPRIGHT VACUUM CLEANER

(75) Inventors: Oliver Liebig, Bielefeld (DE); Udo Mersmann, Guetersloh (DE); Michael Poetting, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 564 days.

(21) Appl. No.: 12/199,094

(22) Filed: Aug. 27, 2008

(65) Prior Publication Data

US 2009/0056056 A1 Mar. 5, 2009

(30) Foreign Application Priority Data

Aug. 30, 2007 (DE) ..... 10 2007 040 953

(51) Int. Cl.
*A47L 9/00* (2006.01)

(52) U.S. Cl. ..... 15/323; 15/324; 15/347

(58) Field of Classification Search ..... 15/347, 15/323, 350–353, 324
See application file for complete search history.

(56) References Cited

U.S. PATENT DOCUMENTS 4,446,594 A * 5/1984 Watanabe et al. ..... 15/323
4,766,640 A * 8/1988 Martin et al. ..... 15/340.1
6,832,409 B2 * 12/2004 Morgan et al. ..... 15/354

FOREIGN PATENT DOCUMENTS

| | | |
|---|---|---|
| EP | 0708613 | 5/1996 |
| WO | WO-2004014209 | 2/2004 |
| WO | WO-2007008770 | 1/2007 |

* cited by examiner

*Primary Examiner* — Dung Van Nguyen
(74) *Attorney, Agent, or Firm* — Leydig, Voit & Mayer, Ltd.

(57) ABSTRACT

An upright vacuum cleaner for cleaning a surface includes an upper body with a dust collection container received therein and a base unit with a front portion with respect to the travel direction of the vacuum cleaner. At least one electrical load is disposed in the front portion of the base unit. A carriage is provided to move the base unit on the surface. The vacuum cleaner includes a tilting joint operable to provide relative tilting between the upper body and the base unit about a tilting axis that is horizontal when the vacuum cleaner is in a position of use. At least one cable is routed between the upper body and the at least one electrical load. A plurality of cable ducts are disposed in the vicinity of the tilting axis and configured to receive the at least one cable.

13 Claims, 5 Drawing Sheets

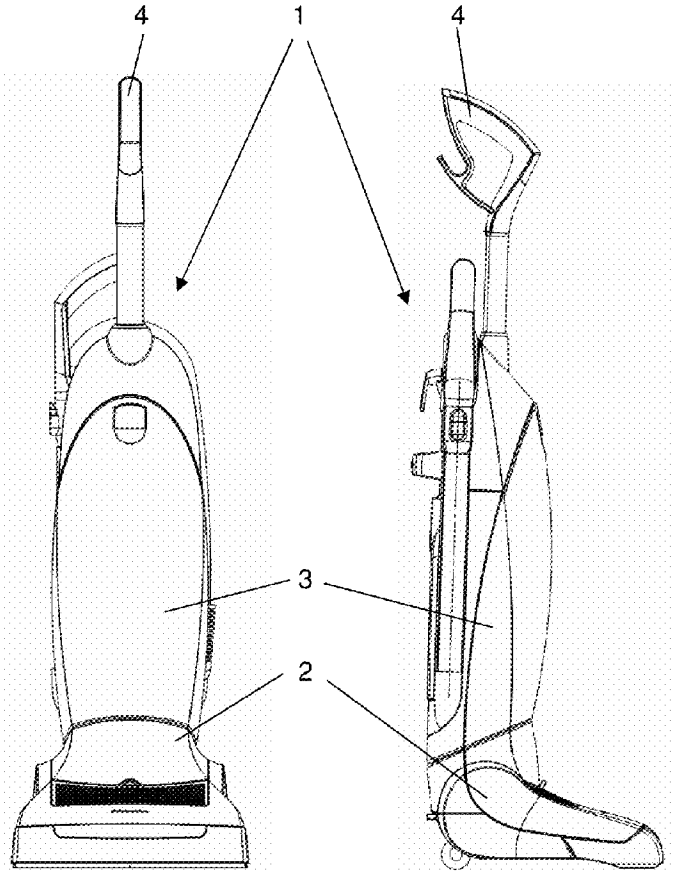
Fig. 1
Fig. 2
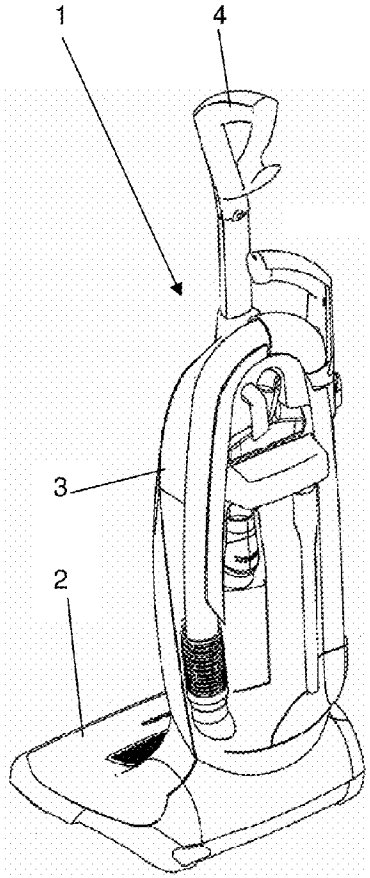
Fig. 3

UPRIGHT VACUUM CLEANER

CROSS REFERENCE TO RELATED APPLICATIONS

Priority is claimed to German patent application DE 10 2007 040 953.4, filed Aug. 30, 2007, which is hereby incorporated by reference herein.

FIELD

The present invention relates to a vacuum cleaner of the upright type, including an upper body containing a dust collection container, a base unit containing electrical loads arranged in the front portion thereof, as viewed in the direction of travel, a carriage permitting said base unit to move on the surface to be cleaned, cables routed between the upper body and the electrical loads in the front portion of the base unit, and a tilting joint enabling the upper body and the base unit to be tilted relative to each other about an axis extending horizontally in a position of use.

BACKGROUND

The following is a description of three types of vacuum cleaners which differ in design and operation. All of them have, as common features, a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor/fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor/fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts may be tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. The motor/fan unit may be mounted at different locations. WO 2007/008770 A2 describes, for example, securing the fan directly to the upper body. From WO 2004/014209 A1 and EP 0 708 613 A1, the fan can be configured as a separate unit. It is also known that the motor/fan unit can be accommodated in the base unit.

WO 2004/014209 A1 describes that the brush motor is mounted in the front portion of the base unit (as viewed in the direction of travel). The front portion may also contain sensors and lamps for illuminating the travel path. These electrical loads are turned on using switches located on the upper body or on the handle. The power cord may also be routed into the upper body. For this reason, it is necessary to route cables from the upper body to the front portion of the base unit. In the region of the tilting joint, these cables are subject to high mechanical stresses.

SUMMARY

An aspect of the present invention is to provide an upright vacuum cleaner in which the electrical cables are protected from excessive stress.

The present invention provides an upright vacuum cleaner for cleaning a surface. The vacuum cleaner includes an upper body with a dust collection container received therein and a base unit with a front portion with respect to the travel direction of the vacuum cleaner. At least one electrical load is disposed in the front portion of the base unit. A carriage is provided that is configured to move the base unit on the surface. The vacuum cleaner includes a tilting joint operable to provide relative tilting between the upper body and the base unit about a tilting axis that is horizontal when the vacuum cleaner is in a position of use. At least one cable is routed between the upper body and the at least one electrical load. A plurality of cable ducts are disposed in the vicinity of the tilting axis and configured to receive the at least one cable.

BRIEF DESCRIPTION OF THE DRAWINGS

An exemplary embodiment of the present invention is described in more detail below and is shown in a schematic way in the drawings, in which:

FIGS. 1 through 6 show various overall views of the vacuum cleaner of the present invention;

DETAILED DESCRIPTION

In an embodiment, the present invention includes arranging the cables in cable ducts around the axis of the tilting joint. This prevents the cables from rubbing against sharp edges during tilting movements, thereby preventing damage to the cable insulation or cable breakage. This also eliminates the risk of pinching.

The upright vacuum cleaner shown in different views in FIGS. 1 through 6 (hereinafter abbreviated as upright 1) includes a base unit 2, an upper body 3, and a joint disposed therebetween, which will be described in greater detail further on in this specification.

Figure 4:
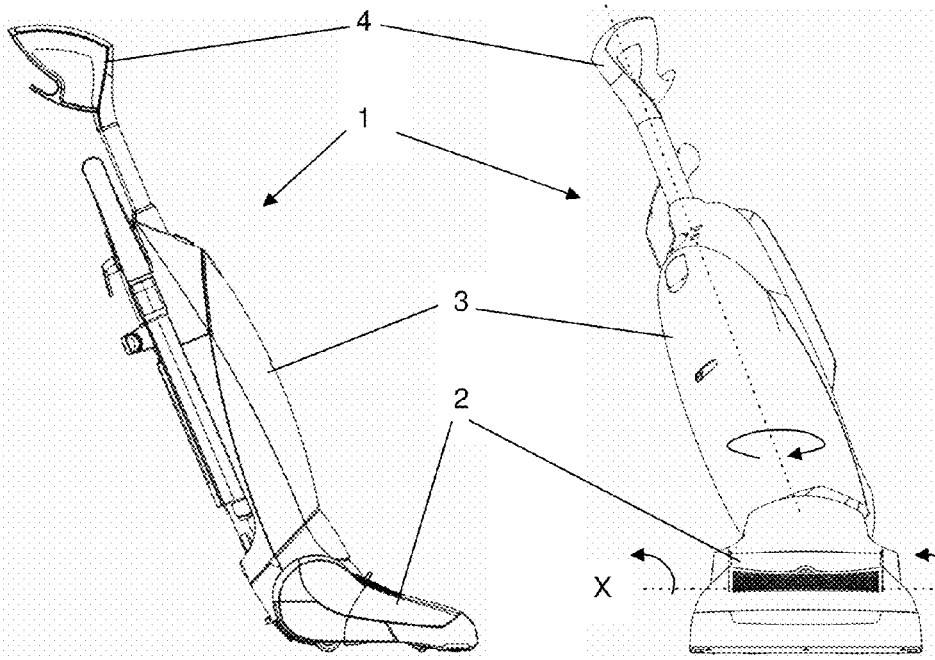
Figure 5:
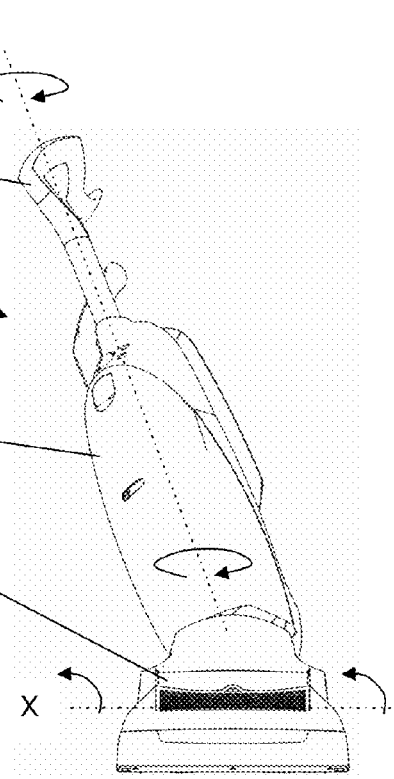
Figure 6:
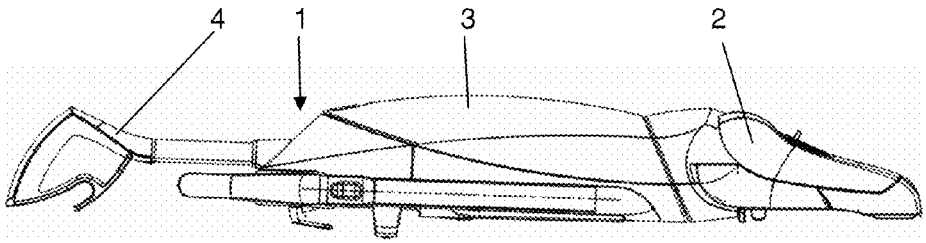

Upright 1 can be brought from an upright position (see FIGS. 1 through 3), in which it can be locked and stand unsupported, to a tilted position (FIGS. 4 and 5), or even to a fully flat position (FIG. 6), after the locked engagement has been released. To this end, base unit 2 and upper body 3 are connected in such a manner that they can be tilted relative to each other about an axis X extending horizontally in a position of use (see FIG. 5). This pivoting movement is made possible by a joint which is hereinafter referred to as a "tilting joint". In the tilted position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as a "swivel joint".

Figure 7:
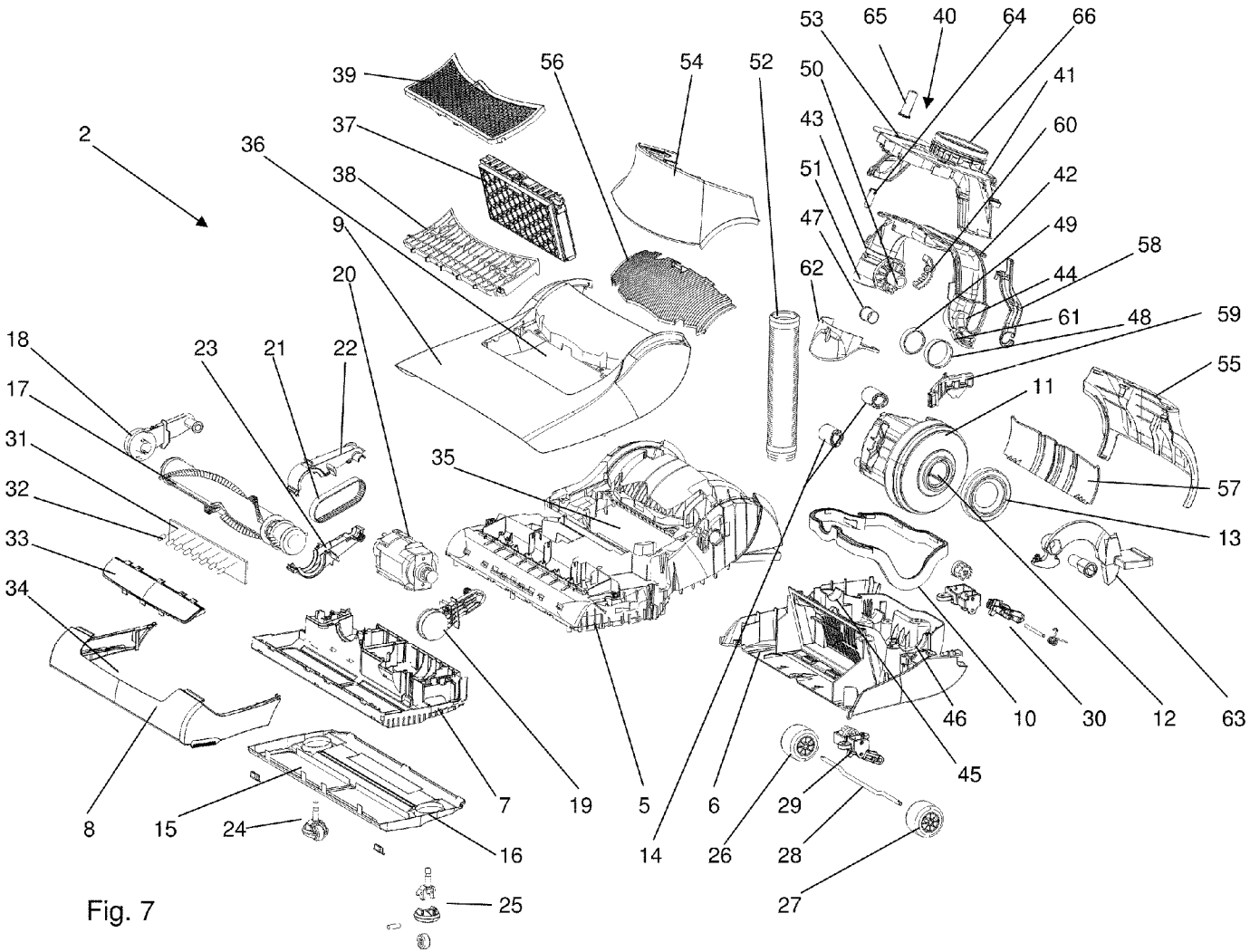
FIG. 7 shows an exploded view showing the base unit of the vacuum cleaner.

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor/fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor/fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is disposed on left yoke end 44. Furthermore, yoke ends 43 and 44 carry toothed segments 60 and 61, which cooperate with wheel mechanisms 29 and 30. A covering cap 62 for a connecting cable is secured to bridge portion 53. To enable the upright to be locked in the upright position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 8:
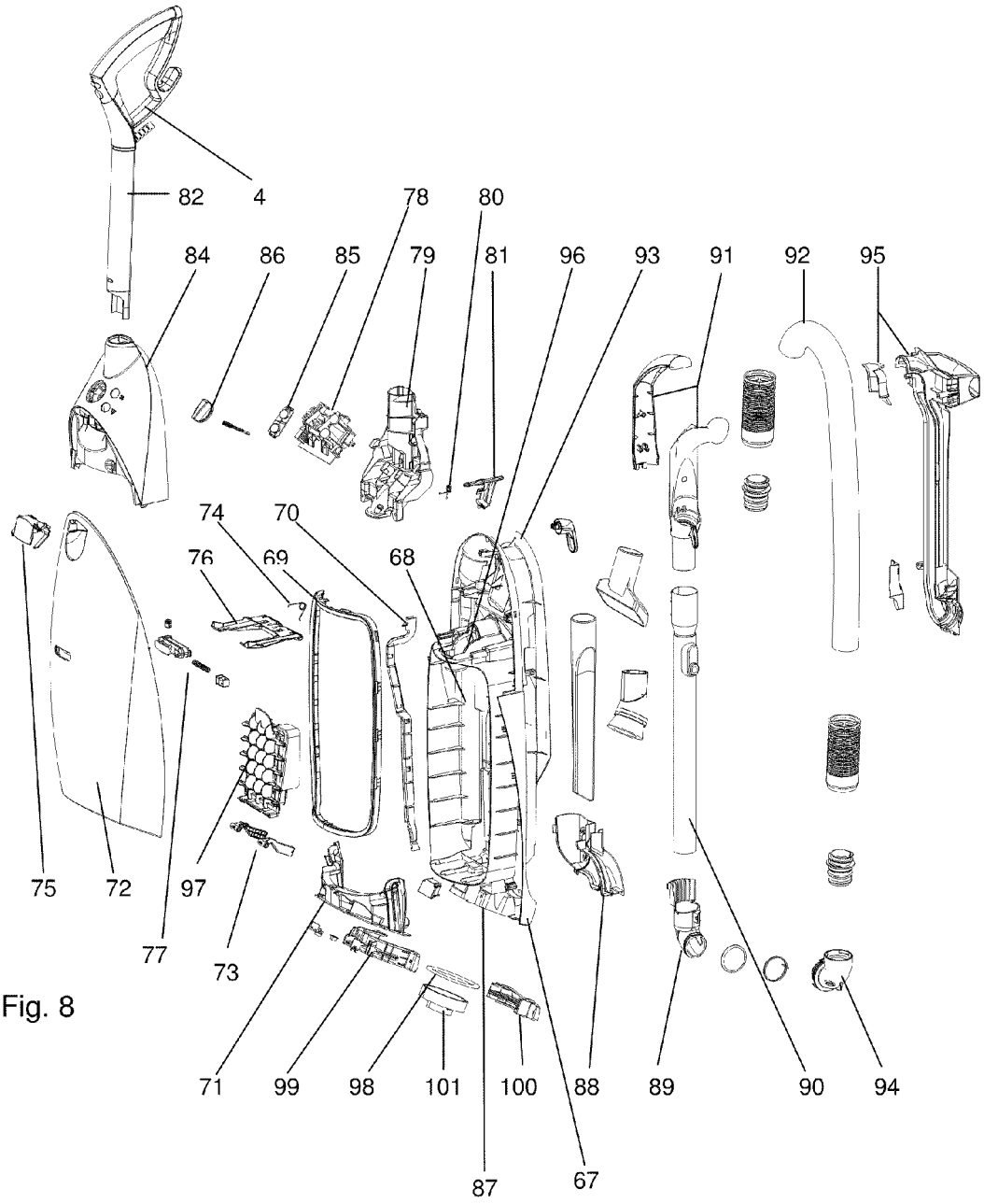
FIG. 8 shows an exploded view illustrating the upper body of the vacuum cleaner.

FIG. 8 shows upper body 3, also in an exploded view. The load-bearing part of upper body 3 is a rear wall 67. The aforesaid rear wall forms the rear portion of a dust chamber 68, which in turn receives a dust collection container in the form of a filter bag. A seal 69 surrounds the edge of dust chamber 68, and a covering strip 70 for cables is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct 83 (see FIG. 10) which extends along the entire length of rear wall 67. Duct 83 is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows only the frame 97 for holding the filter) and into the outer annulus of second section 87 of the coaxial conduit, and from there through first section 66 and left yoke end 44 to motor/fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

Figure 9:
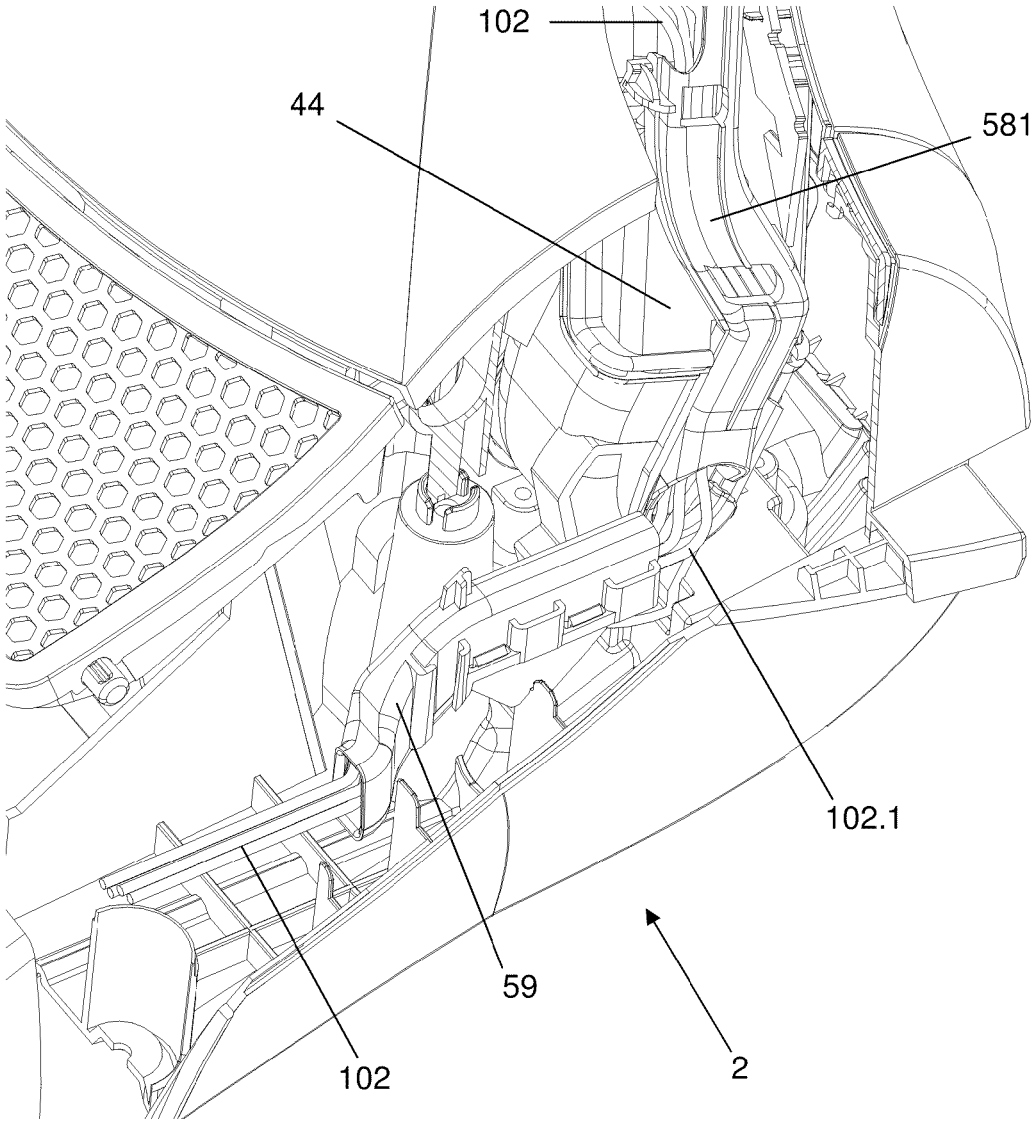
FIG. 9 shows an enlarged portion of the base unit in the region of the tilting joint with the housing insert removed.

FIG. 9 illustrates, in an enlarged view, the routing of cables 102 leading from the upper body to brush motor 20 and to the circuit board carrying the LEDs. The further routing of the cables is not essential to the present invention and is therefore not shown in greater detail. Cables 102 are first routed over left yoke end 44, where they are fixed by first cable cover 581, which is snapped onto the left yoke end, thereby forming a first closed cable duct 58. After a short free path 102.1 in axis X (see FIG. 5) of the tilting joint, cables 102 are further run in a separate second cable duct 59, which also has a closed configuration. At a point outside the range of influence of the tilting joint, the cables emerge from duct 59 and run freely to brush motor 20 and to circuit board 31.

The present invention has been described herein based on one or more exemplary embodiments, but is not limited thereto. Reference should be had to the appended claims.

What is claimed is:

1. An upright vacuum cleaner for cleaning a surface, the vacuum cleaner comprising:

an upper body having a dust collection container received therein;

a base unit having a front portion with respect to a direction of travel;

at least one electrical load disposed in the front portion of the base unit;

a carriage configured to move the base unit on the surface;

a tilting joint operable to provide relative tilting between the upper body and the base unit about a tilting axis extending in a horizontal direction when the vacuum cleaner is in a position of use;

at least one cable routed between the upper body and the at least one electrical load; and a plurality of cable ducts disposed in the vicinity of the tilting axis and configured to receive the at least one cable.

2. The upright vacuum cleaner as recited in claim 1, wherein the tilting joint includes a substantially yoke-shaped duct member, and wherein a first of the cable ducts is disposed on an end of the yoke-shaped duct member.

3. The upright vacuum cleaner as recited in claim 2 wherein a second of the cable ducts extends between the tilting axis and the at least one electrical load in the front portion of the base unit.

4. The upright vacuum cleaner as recited in claim 3 wherein the cable ducts have a closed configuration.

5. The upright vacuum cleaner as recited in claim 2 wherein the cable ducts have a closed configuration.

6. The upright vacuum cleaner as recited in claim 1 wherein the cable ducts have a closed configuration.

7. The upright vacuum cleaner as recited in claim 1 wherein the at least one electrical load includes a motor-fan unit.

8. The upright vacuum cleaner as recited in claim 1 further comprising a brush roller, and wherein the at least one electrical load includes a brush motor operable to drive the brush roller.

9. The upright vacuum cleaner as recited in claim 1 wherein the at least one electrical load includes an illumination device.

10. The upright vacuum cleaner as recited in claim 1 wherein the at least one electrical load includes at least one sensor.

11. The upright vacuum cleaner as recited in claim 1 wherein the at least one electrical load includes a plurality of electrical loads.

12. The upright vacuum cleaner as recited in claim 11 wherein the at least one cable includes a plurality of cables, each of the plurality of cables corresponding to a respective electrical load of the plurality of electrical loads.

13. The upright vacuum cleaner as recited in claim 1 wherein the at least one cable includes a plurality of cables.

* * * * *